US009987738B2

(12) United States Patent
Roehm et al.

(10) Patent No.: US 9,987,738 B2
(45) Date of Patent: Jun. 5, 2018

(54) HAND-HELD POWER TOOL HAVING A TORQUE CLUTCH

(71) Applicant: Robert Bosch GmbH, Stuttgart (DE)

(72) Inventors: Heiko Roehm, Stuttgart (DE); Ralf Windsheimer, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 840 days.

(21) Appl. No.: 14/091,620

(22) Filed: Nov. 27, 2013

(65) Prior Publication Data

US 2014/0144661 A1 May 29, 2014

(30) Foreign Application Priority Data

Nov. 29, 2012 (DE) ..... 10 2012 221 906

(51) Int. Cl.
*B25B 23/14* (2006.01)
*B25F 5/00* (2006.01)

(52) U.S. Cl.
CPC ..... *B25F 5/001* (2013.01); *B25B 23/141* (2013.01)

(58) Field of Classification Search
CPC . B25B 23/141; B25F 5/001; B25D 2250/165; B23B 2260/0445
See application file for complete search history.

(56) References Cited

U.S. PATENT DOCUMENTS 3,662,628 A * 5/1972 Schnepel ..... B25B 23/141 464/36
5,356,350 A * 10/1994 Schreiber ..... B25B 23/141 192/150
5,595,099 A 1/1997 Pusateri
6,244,358 B1 * 6/2001 Beer ..... B25B 21/00 173/170
7,028,589 B1 4/2006 Cheng
7,669,507 B2 * 3/2010 Furusawa ..... B25B 21/00 81/475
8,528,658 B2 * 9/2013 Roehm ..... B23B 31/1207 173/176
8,851,201 B2 * 10/2014 Limberg ..... F16D 7/044 173/178
9,027,666 B2 * 5/2015 Hecht ..... B23B 45/008 173/178

(Continued)

FOREIGN PATENT DOCUMENTS

CN 1829588 A 9/2006
CN 102271869 A 12/2011
DE 10 2009 046 663 7/2010

OTHER PUBLICATIONS

Pins, Rollers, Shafts and brochure, Jan. 1, 2012, RBC Bearings, http://www.rbcbearings.com/PinsRollersShafts/index.htm.*

*Primary Examiner* — Andrew M Tecco
(74) *Attorney, Agent, or Firm* — Norton Rose Fulbright US LLP; Gerard Messina

(57) ABSTRACT

In a hand-held power tool having a transmission and a torque clutch, which has a torque limiting coupling associated with the transmission and with which a limiting transfer element is associated, to which at least one spring element is axially applied in the direction of the torque limiting coupling, a torque level of the torque clutch being settable via a user-operable operating element at least within predefined limits, the torque limiting coupling has at least one roller-shaped latch member.

8 Claims, 2 Drawing Sheets

(56) References Cited

U.S. PATENT DOCUMENTS

| | | | | |
|---|---|---|---|---|
| 9,162,349 | B2 * | 10/2015 | Ikuta | B25B 23/141 |
| 2006/0086215 | A1 * | 4/2006 | Furusawa | B25B 21/00 81/475 |
| 2011/0127059 | A1 * | 6/2011 | Limberg | F16D 7/044 173/216 |
| 2011/0147022 | A1 * | 6/2011 | Roehm | B23B 31/1207 173/47 |
| 2012/0132449 | A1 * | 5/2012 | Hecht | B23B 45/008 173/5 |
| 2013/0048330 | A1 * | 2/2013 | Ikuta | B25B 23/141 173/216 |

* cited by examiner

HAND-HELD POWER TOOL HAVING A TORQUE CLUTCH

CROSS REFERENCE TO RELATED APPLICATION

The present application claims priority to Application No. DE 10 2012 221 906.4, filed in the Federal Republic of Germany on Nov. 29, 2012, which is expressly incorporated herein in its entirety by reference thereto.

FIELD OF INVENTION

The present invention relates to a hand-held power tool having a transmission and a torque clutch, which has a torque limiting coupling, which is associated with the transmission, and with which a limiting transfer element is associated, to which at least one spring element is axially applied in the direction of the torque limiting coupling, a torque level of the torque clutch being settable at least within predefined limits via a user-operable operating element.

BACKGROUND INFORMATION

Such a hand-held power tool having a transmission, which is designed like a planetary gear, and a torque clutch, which has a torque limiting coupling associated with the transmission and the torque level of which is settable within predefined limits via an associated torque setting sleeve, is described in German Application No. DE 10 2009 046 663. The torque clutch has a limiting transfer element, to which a predefined spring force is axially applied by a spring element in the direction of latch members, and with which the torque limiting coupling is associated. The latch members are designed to be spherical and the limiting transfer element is applied to them toward an annulus gear of the planetary gear.

The related art has the disadvantage that the spherical latch members only produce a point contact with the annulus gear of the planetary gear, so that a plurality of such latch members is necessary to form a robust torque clutch. This results in increased wear on the annulus gear during clutch operation of the torque clutch.

SUMMARY

An object of the present invention is therefore to provide a novel hand-held power tool, which has at least one comparatively low-wear torque clutch.

This object is achieved by a hand-held power tool having a transmission and a torque clutch, which has a torque limiting coupling, which is associated with the transmission, and with which a limiting transfer element is associated, to which at least one spring element is axially applied in the direction of the torque limiting coupling. A torque level of the torque clutch is settable at least within predefined limits via a user-operable operating element. The torque limiting coupling has at least one roller-shaped latch member.

The present invention therefore allows the provision of a hand-held power tool, in which a low-wear torque clutch may be implemented by a use of roller-shaped latch members and in which vibrations occurring during clutch operation may be at least reduced. In addition, such roller-shaped latch members allow a reduction of the overall length of the hand-held power tool and, by way of a linear contact with the transmission, an increased precision in the event of triggering of the clutch operation.

According to one exemplary embodiment, the torque limiting coupling has at least three roller-shaped latch members.

A number of components required for implementing the torque clutch may therefore at least be reduced, in particular the number of required latch members. In this way, the torque clutch may be implemented more cost-effectively and having a reduced weight. In addition, by such a reduction of the number of the latch members, a corresponding rigidity of a transmission housing associated with the transmission may be increased, since only a reduced number of openings for mounting the latch members are to be formed therein.

The at least three roller-shaped latch members are preferably arranged radially on the transmission.

A more stable and robust construction of the torque clutch may thus be made possible.

The at least one spring element preferably has at least three compression springs.

Therefore, a safe and reliable axial application of the limiting transfer element in the direction of the torque limiting coupling may be ensured.

According to one exemplary embodiment, the at least one spring element has a first number of compression springs and a second number of roller-shaped latch members is provided. The first number is preferably greater than the second number.

The present invention therefore allows the provision of a hand-held power tool having a torque clutch, which allows improved smooth running and in which the vibrations occurring during clutch operation may at least be reduced.

According to one exemplary embodiment, the transmission has at least one annulus gear, the limiting transfer element applying force to the at least one roller-shaped latch member against the annulus gear. The at least one roller-shaped latch member is preferably designed to roll off on the annulus gear.

The present invention therefore allows in a simple way the provision of a torque clutch having a latch member, which forms a linear contact to the annulus gear of the transmission by its roller shape and therefore in particular allows a low-wear clutch operation of the torque clutch.

The torque limiting coupling is preferably deactivated in a predefined position of the user-operable operating element.

Therefore, a hand-held power tool having a torque clutch may be provided, which is operable safely and reliably in different operating modes, the torque clutch being able to be activated in a first mode and being able to be deactivated in a second mode.

According to one exemplary embodiment, a torque setting device is provided, which is designed for the purpose of allowing a setting of a spring force, which is exerted by the at least one spring element, for setting the torque level.

The present invention therefore allows the provision of a torque clutch in which a particular desired torque level is settable in an uncomplicated and rapid way.

The at least one roller-shaped latch member preferably has a length and a diameter, the length being less than the diameter.

The diameter of the hand-held power tool may therefore be reduced and therefore its weight may be decreased.

Exemplary embodiments of the present invention are described in greater detail in the following with reference to the accompanying drawings.

DETAILED DESCRIPTION

Figure 1:
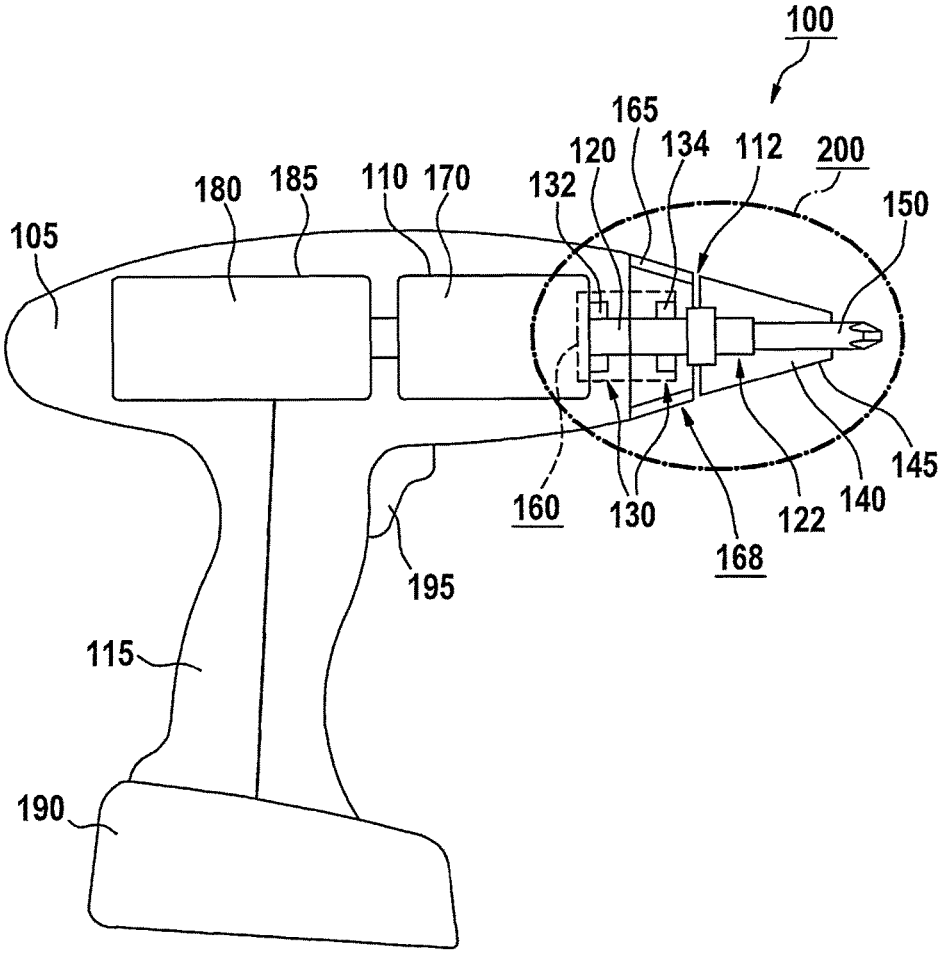
FIG. 1 shows a schematic view of a hand-held power tool having a torque clutch according to the present invention.

FIG. 1 shows an exemplary hand-held power tool 100, which is provided with a torque clutch 160, and which has a tool housing 105 having a handle 115. According to one exemplary embodiment, hand-held power tool 100 is mechanically and electrically connectable to a battery pack 190 for network-independent power supply. In FIG. 1, hand-held power tool 100 is designed as a cordless combi drill, for example. However, it is to be noted that the present invention is not restricted to cordless combi drills, but rather may be used in various hand-held power tools, which have a torque clutch corresponding to torque clutch 160, independently of whether the hand-held power tool is operable electrically, i.e., in a network-independent way using battery pack 190 or in a network-dependent way, and/or non-electrically.

An electric drive motor 180, which is supplied with power by battery pack 190, and a transmission 170 are situated in tool housing 105 as examples. Drive motor 180 is connected via transmission 170 to a drive shaft 120, for example, a drive spindle. Drive motor 180 is situated in the illustration in a motor housing 185 and transmission 170 is situated in a transmission housing 110, transmission housing 110 and motor housing 185 being situated in tool housing 105 as an example. Transmission 170 is designed to transmit a torque, which is generated by drive motor 180, to drive spindle 120 and, according to one exemplary embodiment, to a planetary gear designed having various gear stages or planetary stages, which is rotatably driven by drive motor 180 during operation of hand-held power tool 100. Drive motor 180 is operable, i.e., may be turned on and off, via a hand switch 195, for example, and may be any arbitrary motor type, for example, an electronically commutated motor or a DC motor. Drive motor 180 may preferably be electronically controlled or regulated such that both reversing operation and specifications with respect to a desired rotational speed are implementable. The mode of operation and the construction of a suitable drive motor are sufficiently known from the related art, so that a detailed description will be omitted here for the sake of conciseness.

Drive spindle 120 is rotatably mounted via a bearing assembly 130 in tool housing 105 and is provided with a tool receptacle 140, which is situated in the area of a front side 112 of tool housing 105 and has a drill chuck 145, for example. Bearing assembly 130 has, according to one exemplary embodiment, at least two bearing points 132, 134, which are provided in tool housing 105 in an area (299 in FIG. 2) downstream from transmission 170. Associated bearings (232, 234 in FIG. 2), which are used as spindle bearings and in which drive spindle 120 is mounted so it is rotationally movable, are situated on bearing points 132, 134.

Tool receptacle 140 is used to accommodate a tool 150 and may be fitted onto drive spindle 120 or may be connected thereto in the form of an attachment. In FIG. 1, tool receptacle 140 is designed like an attachment, for example, and is fastened on drive spindle 120 via a fastening device 122 provided thereon.

According to one exemplary embodiment, hand-held power tool 100 has a torque clutch 160, as described above. As an illustration, this is provided with a torque setting device 168, which is associated with an operating element 165, which is operable by a user of hand-held power tool 100. User-operable operating element 165 is designed for the setting of a particular torque limit desired by the user, for example, a work-specific torque limit, by torque clutch 160, or for setting a particular torque level of torque clutch 160, at least within predefined limits. For this purpose, operating element 165 of torque clutch 160 is designed in the form of a sleeve, for example, and is therefore also designated hereafter as "torque setting sleeve" 165. Torque clutch 160 will be described hereafter with reference to the view of detail 200 of hand-held power tool 100 which is shown in an enlarged form in FIG. 2.

Figure 2:
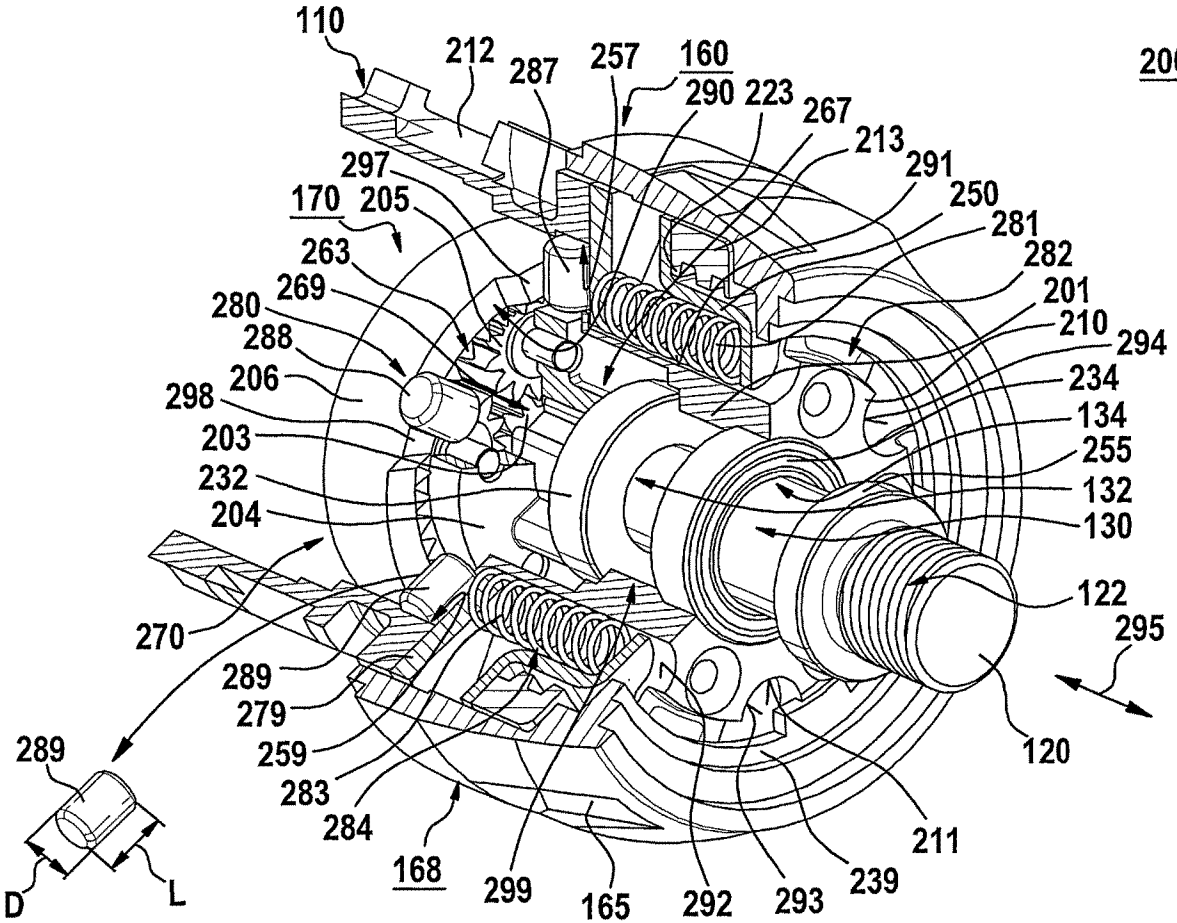
FIG. 2 shows an enlarged exploded view of a detail of the hand-held power tool from FIG. 1 according to one exemplary embodiment having the torque clutch set in a first operating position.

FIG. 2 shows detail 200 of hand-held power tool 100 from FIG. 1, in which, for the purpose of clarity and simplicity of the drawing, an illustration of tool 150, tool receptacle 140, and tool housing 105 from FIG. 1 was omitted. Detail 200 illustrates an exemplary design of planetary gear 170, drive spindle 120, bearing assembly 130, and torque clutch 160 according to one exemplary embodiment.

Planetary gear 170 may have multiple gear stages or planetary stages, of which only one front stage 270 is illustrated in FIG. 2 for the purpose of simplicity and clarity of the drawing. This front stage has, for example, a sun wheel 203 having gear teeth 269, at least one planet wheel 205 having gear teeth 263, a planet carrier 204 having a rotational entrainment contour 267, and an annulus gear 206. A corresponding torque of drive motor 180 from FIG. 1 is transmitted via this front planetary stage 270 with the aid of rotational entrainment contour 267 of planet carrier 204 to drive spindle 120. In this case, planet carrier 204 is used as a drive element, to rotatably drive drive spindle 120. Since the construction of a planetary gear is sufficiently known to those skilled in the art, an illustration and description of further planetary stages will be omitted here for the sake of conciseness.

Planetary stage 270 is situated in the illustration in transmission housing 110, which has, for example, a front part 210 and a rear part 212, front part 210 and rear part 212 being formed in one piece, for example, but also being able to be formed in two pieces as an alternative thereto, however. Front part 210, which is provided with an external circumference 211, has an external thread 282 as an illustration, on which a setting ring 213 is rotatably mounted, for example. On the inner circumference of front part 210, in which drive spindle 120 is mounted in bearing assembly 130, a ring-shaped shoulder 201 is formed, for example.

Drive spindle 120 has a fastening device 122, which is formed in the illustration as an external thread, and on which drill chuck 145 of tool receptacle 140 of FIG. 1 is fastenable, external thread 122 being able to be moved into a threaded engagement with an internal thread provided on drill chuck 145. In addition, a support flange 255 is provided on drive spindle 120, for example.

Bearing assembly 130 is situated, for example, in an area 299 downstream from transmission 170 and has in the illustration a slide bearing 232, for example, a sintered bearing, and a roller bearing 234, for example, a ball bearing. Sintered bearing 232 is situated, for example, on bearing point 132, which is also designated hereafter as the first bearing point, and which is situated downstream from planet carrier 204 and therefore from transmission 170 viewed in the direction of tool receptacle 140 of FIG. 1. Ball bearing 234 is situated, for example, on bearing point 134, which is also designated hereafter as the second bearing point, and which is situated downstream from first bearing point 134 at a predefined spacing viewed in the direction of tool receptacle 140 of FIG. 1. In this case, sintered bearing 232 and ball bearing 234 are spaced apart from one another via ring-shaped shoulder 201, for example, so that a further functional group may be situated in the area of ring-shaped shoulder 201, for example, a latch mechanism. However, it is to be noted that such a latch mechanism and its mode of operation are sufficiently known to those skilled in the art from the related art, so that a detailed description thereof will be omitted here for the sake of conciseness.

Torque clutch 160 has, in the illustration, torque setting device 168 from FIG. 1, which is provided with torque setting sleeve 165, a torque limiting coupling 280, 290, which is associated with transmission 170, at least one limiting transfer element 279, at least one spring retention element 250, and at least one assigned spring element 284. In this case, the at least one spring element 284 is clamped between limiting transfer element 279 and spring retention element 250.

The at least one spring element 284 is designed for the purpose of applying a predefined spring force axially to limiting transfer element 279 in the direction of torque limiting coupling 280, 290. In this case, the predefined spring force is settable within predefined limits via torque setting device 168. For this purpose, spring retention element 250 is pre-tensioned by the predefined spring force of the at least one spring element 284 toward setting ring 213, to which torque setting sleeve 165 of torque setting device 168 may be applied for axial displacement in the longitudinal direction of the at least one spring element 284.

Setting ring 213 has, for example, engagement elements 223, which engage in external thread 282 formed on external circumference 211 of front part 210 of transmission housing 110. These engagement elements are used for the purpose, in the event of a twist of setting ring 213, to guide setting ring 213 on external thread 282 by twisting torque setting sleeve 165 and therefore causing an axial displacement of setting ring 213 in the longitudinal direction of drive spindle 120, as indicated by an arrow 295.

According to one exemplary embodiment, torque setting sleeve 165 of torque setting device 168 is axially fixed in location on front part 210 of transmission housing 110. This is carried out, for example, via a retaining plate, which is screwed onto front part 210 via associated screws, for example, and may be supported against an outer ring of ball bearing 234. The retaining plate, the illustration of which will be omitted for the sake of simplicity and clarity of the drawing, encompasses drive spindle 120 and presses against a ring shoulder 239 in torque setting sleeve 165, so that in this way torque setting sleeve 165 is also axially secured on transmission housing 110.

Torque setting sleeve 165 is designed, as described in FIG. 1, for the setting of a particular torque limit or torque level which is desired by the user, for example, a work-specific torque limit or torque level, by torque clutch 160, in particular by setting a spring force exerted by the at least one spring element 284 on limiting transfer element 279. In its position shown in FIG. 2, this torque limiting is maximal, i.e., the at least one spring element 284 is at least largely relaxed, so that torque clutch 160 is activated and therefore, for example, a screwing mode of hand-held power tool 100 of FIG. 1 may be implemented. In an alternative position of torque setting sleeve 165, in which spring retention element 250 is blocked by setting ring 213 such that the at least one spring element 284 is at least largely tensioned, torque clutch 160 is deactivated, so that, for example, a drilling mode of hand-held power tool 100 of FIG. 1 may be implemented. To reach this alternative position, spring retention element 250 is displaced via setting ring 213 by a twist of torque setting sleeve 165 to compress the at least one spring element 284 axially in the direction of limiting transfer element 279. However, it is to be noted that the mode of operation of a torque clutch is sufficiently known to those skilled in the art, so that a detailed description of the mode of operation of torque clutch 160 will be omitted here for the sake of conciseness.

The at least one spring element 284 preferably has at least three and, for example, a plurality of compression springs, in particular helical compression springs, which are mounted in associated grooved recesses. In the exemplary embodiment shown in FIG. 2, a total of six recesses are provided, so that a total of six helical compression springs are used. A separate grooved recess is preferably provided in this case for each helical spring, in the illustration, two helical compression springs 281, 283 being mounted in two assigned grooved recesses 291 and 292, respectively, and two further recesses being identified with reference numerals 293, 294. These grooved recesses 291, 292, which are also designated hereafter as "receptacle grooves," are formed, for example, on outer circumference 211 of front part 210 of transmission housing 110 in its longitudinal direction and distributed equidistantly over external circumference 211, for example. Limiting transfer element 279 is formed in the illustration like a compression disk or compression plate, which presses on its side facing away from helical compression springs 281, 283 against at least one and preferably three of the roller-shaped latch members which are associated with torque limiting coupling 280, 290. However, it is to be noted that a greater number of latch members may also be used. According to one exemplary embodiment, at least a number of roller-shaped latch members is provided in this case, which is less than or equal to a number of helical compression springs used to implement the at least one spring element 284.

In the illustrated exemplary embodiment, six latch members are provided as an example, of which only three latch members, which are designated with reference numerals 287, 288, 289, are visible. These have force applied to them, by the side of limiting transfer element 279 facing away from helical compression springs 281, 283, against a latch disk associated with transmission 170, which is formed in the illustration by annulus gear 206 of front planetary stage 270. According to one exemplary embodiment, the latch members each have a length L and a diameter D, length L being greater than diameter D, as illustrated as an example on the basis of an enlargement of latch member 289. The latch members are preferably designed to be cylindrical in this case and therefore have a cylinder jacket, which has diameter D at least essentially over its entire axial length.

It is to be noted that the above described length-to-diameter ratio only has exemplary character and is not to be understood as a restriction of the present invention. Rather, length L may also be selected to be less than diameter D, to thus allow a reduction of an overall diameter of transmission housing 110.

Roller-shaped latch members 287, 288, 289 are preferably situated radially on transmission 170 and are mounted for this purpose in associated openings of transmission housing 110, so that their latch member center axes are aligned at least essentially perpendicularly to the longitudinal axis of drive spindle 120. In the illustration, latch members 287, 289 are mounted in associated openings 257 and 259, respectively, which are formed, for example, in a transition area between front part and rear part 210 and 212 of transmission housing 110. In this case, roller-shaped latch members 287,

288, 289 are situated in the axial direction of drive spindle 120 between a front side of annulus gear 206, which forms the latch disk, on which a coupling structure 290 is formed, and limiting transfer element 279. Roller-shaped latch members 287, 288, 289, which have force applied to them by limiting transfer element 279 against annulus gear 206, are preferably designed to roll off on annulus gear 206 during clutch operation.

Coupling structure 290 forms, with roller-shaped latch members 287, 288, 289, torque limiting coupling 280, 290 and has in the illustration a plurality of axial protrusions, of which two protrusions are identified with reference numerals 297, 298 as an example. These protrusions extend from annulus gear 206 in the direction of actuating element 279 and have rising and falling protrusion flanks, on which they are each in linear contact with latch members 287, 288, 289 at all times via a corresponding latch member stroke. However, it is to be noted that a coupling structure suitable for implementing coupling structure 290 is sufficiently known to those skilled in the art, so that a detailed description of coupling structure 290 will be omitted here for the sake of conciseness.

What is claimed is:

1. A hand-held power tool, comprising:

a transmission, and a torque clutch, which has a torque limiting coupling associated with the transmission and to which a limiting transfer element is associated, to which at least one spring element is axially applied in the direction of the torque limiting coupling, a torque level of the torque clutch being settable at least within predefined limits via a user-operable operating element, wherein the torque limiting coupling has at least one cylindrical roller-shaped latch member having a cylindrical surface, wherein the at least one spring element has a first number of compression springs, and a second number of cylindrical roller-shaped latch members is provided, the first number being at least as great as the second number, wherein the transmission has at least one annulus gear with a front side on which a coupling structure is formed, the limiting transfer element applying force to the cylindrical roller-shaped latch members toward the front side of the annulus gear, wherein the cylindrical surface of the cylindrical roller-shaped latch members is adapted to roll off over the coupling structure of the annulus gear.

2. The hand-held power tool according to claim 1, wherein the torque limiting coupling has at least three roller-shaped latch members.

3. The hand-held power tool according to claim 2, wherein the at least three roller-shaped latch members are arranged radially on the transmission.

4. The hand-held power tool according to claim 1, wherein the at least one spring element has at least three compression springs.

5. The hand-held power tool according to claim 1, wherein the transmission has at least one annulus gear, the limiting transfer element applying force to the at least one roller-shaped latch member toward the annulus gear.

6. The hand-held power tool according to claim 5, wherein the at least one roller-shaped latch member is adapted to roll off over at least a portion of the annulus gear.

7. The hand-held power tool according to claim 1, wherein the torque limiting coupling is deactivated in a predefined position of the user-operable operating element.

8. The hand-held power tool according to claim 1, further comprising:

a torque setting device associated with the user-operable operating element, which is adapted to allow a setting of a spring force exerted by the at least one spring element for setting the torque level.

* * * * *